US005860464A

United States Patent [19]

Schön

[11] Patent Number: 5,860,464

[45] Date of Patent: Jan. 19, 1999

[54] RETRACTABLE BLIND OR SHADE ASSEMBLY

[75] Inventor: Siegfried Joachim Schön, Meer, Belgium

[73] Assignee: Schon B.V., Netherlands

[21] Appl. No.: 781,744

[22] Filed: Jan. 10, 1997

Related U.S. Application Data

[63] Continuation of Ser. No. 400,791, Mar. 8, 1995, abandoned.

[30] Foreign Application Priority Data

| | | | |
|---|---|---|---|
| Mar. 8, 1994 | [EP] | European Pat. Off. | 94200602 |
| Mar. 8, 1994 | [EP] | European Pat. Off. | 94200603 |
| Jun. 23, 1994 | [EP] | European Pat. Off. | 94201822 |

[51] Int. Cl.[6] ..... A47H 1/18

[52] U.S. Cl. ..... 160/84.6; 160/86.07

[58] Field of Search ..... 160/84.04, 84.06, 160/84.07, 84.1 F, 84.05, 113

[56] References Cited

U.S. PATENT DOCUMENTS

| | | | |
|---|---|---|---|
| 4,647,488 | 3/1987 | Schnebly et al. | 160/84.05 |
| 4,673,018 | 6/1987 | Judkins | 160/84.06 |
| 4,687,038 | 8/1987 | Clemente | 160/84.06 |
| 4,762,159 | 8/1988 | Ford | 160/84.06 |
| 4,799,524 | 1/1989 | Guermonprez | 160/84.04 |
| 4,842,034 | 6/1989 | Haines | 160/84.04 |
| 4,901,419 | 2/1990 | Voss | 160/84.04 |
| 5,092,383 | 3/1992 | Niemeijer et al. . | |
| 5,495,883 | 3/1996 | Jelic | 160/84.04 |
| 5,566,734 | 10/1996 | Levy et al. | 160/84.04 |

FOREIGN PATENT DOCUMENTS

| | | |
|---|---|---|
| 0 240 065 B1 | 6/1989 | European Pat. Off. . |
| 240065 | 6/1989 | European Pat. Off. . |
| 05 32 036 A2 | 3/1993 | European Pat. Off. . |
| 532036 | 3/1993 | European Pat. Off. . |
| 0 599 092 A2 | 6/1994 | European Pat. Off. . |
| 599092 | 6/1994 | European Pat. Off. . |
| 4015627 | 5/1994 | Germany . |
| 9401562.7 | 5/1994 | Germany . |

*Primary Examiner*—Daniel P. Stodola
*Assistant Examiner*—Curtis Cohen
*Attorney, Agent, or Firm*—Dorsey & Whitney LLP

[57] ABSTRACT

A retractable blind or shade assembly for covering a polygonal contoured surface area, includes a retractable covering member (2, 16, 36, 37, 55), a movable member (3, 39, 60') and at least one cord member (9, 43, 44, 58). At least one cord member (9, 43, 44, 58) is provided between its terminal ends with a looped connection (10, 10') adapted to engage the movable member (3, 39, 60') upon a predetermined amount of relative movement between the movable member (3, 39, 60') and the one cord member (9, 43, 44, 58) in one direction, while otherwise relative movement between the movable member (3, 39, 60') and the cord member (9, 43, 44, 58) is independent of one another. The assembly enables the engagement of a further element without obstruction to being guided through openings or around deflecting surfaces and pulley wheels, such as are often part of a blind or shade structure.

37 Claims, 7 Drawing Sheets

RETRACTABLE BLIND OR SHADE ASSEMBLY

CROSS REFERENCE TO RELATED APPLICATION

This application is a continuation of application Ser. No. 08/400,791, filed Mar. 8, 1995, now abandoned.

BACKGROUND OF THE INVENTION

1. Field of the Invention

The invention relates to a retractable blind or shade assembly for covering a polygonal contoured surface area, comprising a retractable covering member, a movable member and at least one cord member.

2. Brief Description of the Prior Art

It is conventional to use cord arrangements in retractable blinds or shades.

Either such cords are stationary to guide the movement of movable blind or shade components such as bottom rails or such cords move themselves to induce movement of rail members and the like.

It has sometimes been necessary for such cords to engage additional, secondary components of the blind or shade upon a predetermined movement of a primary blind component.

The prior art is disclosed by European patent publication 0 240 065.

The prior art structures have not always resulted in products that were easy to assemble. Moreover there have often been limitations to the configuration and size of the openings that could be provided with such blinds or shades.

OBJECT OF THE INVENTION

The present invention has as its object the provision of according arrangement that enables the engagement of a further element while forming itself no obstruction while being guided through openings or around deflecting surfaces and pulley wheels such as are often part of a blind or shade structure.

SUMMARY OF THE INVENTION

According to one aspect of the present invention the blind assembly is distinguished in that said at least one cord member is provided between its terminal ends with engagement means, said engagement means being adapted to engage said movable member upon a predetermined amount of relative movement between said movable member and said at least one cord member in one direction, while otherwise relative movement between said movable member and said at least one cord member is independent of one another.

The invention further relates to a blind or shade assembly which is in particular adapted for covering irregularly shaped window openings. In the past such irregularly shaped window openings have posed many problems and over time one has managed to come up with solutions for strictly triangular and trapezoidal window openings. However, polygonal window openings, especially of the kind having a generally rectangular outline, but with one of the corners "cut off" so as to form a partly inclined side portion, have so far been the most difficult ones to tackle. The invention provides a solution for this kind of installations.

The retractable covering member can be formed by way of example as a flexible material sheet member that is either foldable, pleatable or rollable.

Also the retractable covering member can be formed as a collapsible slatted blind in which the vanes or slats may be pivotally adjustable for additional light regulation. The movable member can either be directly assisting in deploying or retracting the covering member or it can be represented by an auxiliary element contributing indirectly to the extensive and retractive movements.

The invention will be further elucidated in the description of several embodiments as stated herebelow.

DESCRIPTION OF THE PREFERRED EMBODIMENT

Figure 1:
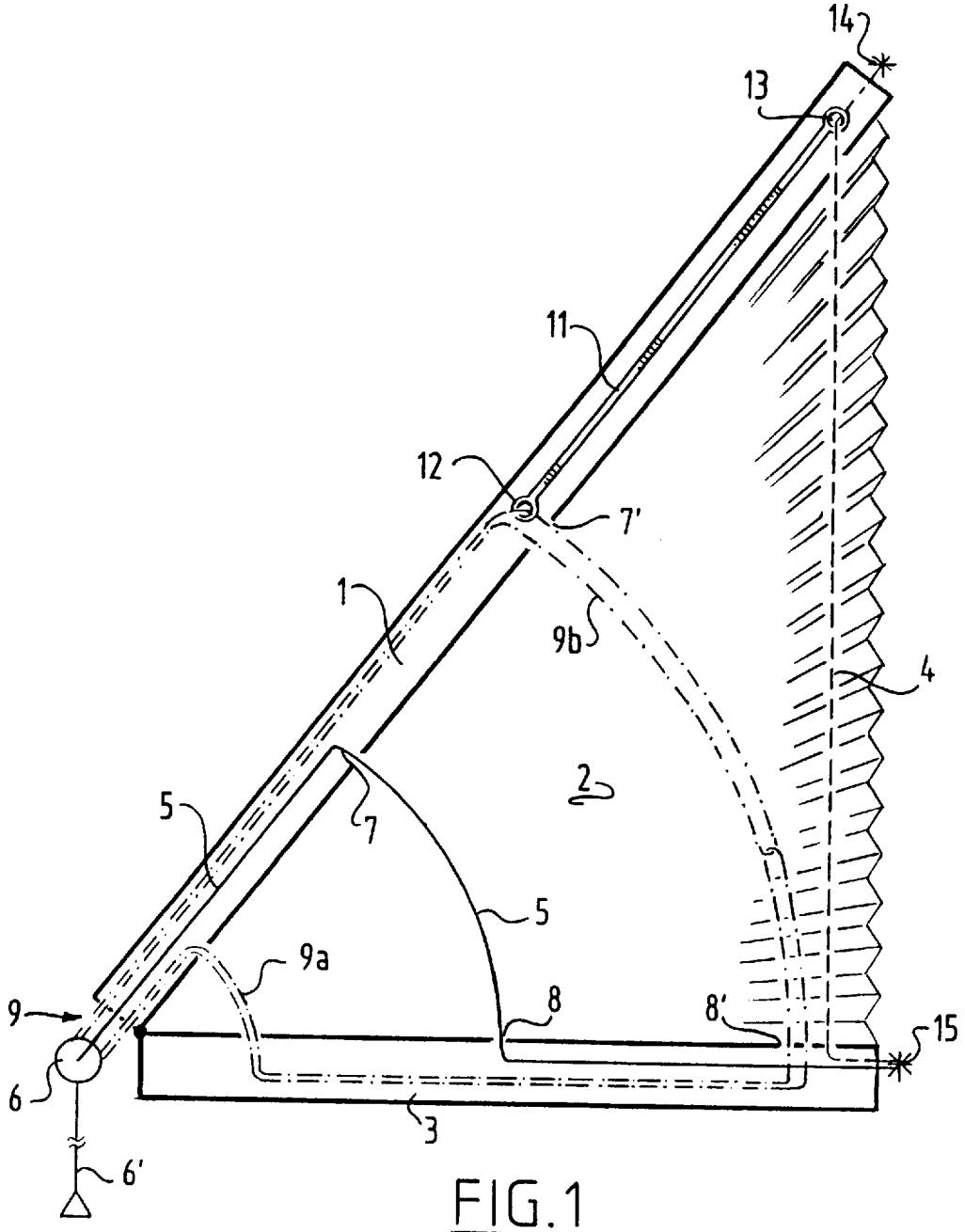
FIG. 1 is a schematic elevated view of the blind according to a first embodiment of the invention.

FIG. 1 shows a retractable triangular blind embodying the present invention. The blind according to this embodiment comprises a fixed head or top rail 1 as support structure, a covering member 2, preferably made from pleated material, and a raisable bottom rail or movable member 3, connected to said pleated material.

Further said blind assembly is provided with an extension cord 4 close to the vertical border of the covering member. The extension cord 4 controls the lower most position of rail 3 and also supports the vertical border of the covering member 2 in its extended position.

Basically the cord arrangement for guiding and supporting the blind of FIG. 1 comprises a first branch of lift cord 5, which extends from a cord collector 6 to a cord guide means 7 along the length of head rail 1. From said guide means 7 the lift cord 5 crosses the distance between the head rail 1 and bottom rail 3 towards a further cord guide means such as holes or apertures 8 in bottom rail 3 and is fixed at an end of said bottom rail 3. Alternatively the cord 5 may also be fixedly held by the cord guide 8, but the illustrated connection to an end cap of the bottom rail at 15 will generally be preferred for ease of assembly. The structure of the cord guide means is not shown in detail as this is common art. Schematically the guide means is an opening in the rail.

A second branch of lift cord or cord member 9 is provided in the form of two double cords 9*a* and 9*b* which are looped into each other to form a looped connection or engagement means 10, see also FIGS. 4*a–e*.

The cord loop extends from cord collector 6 via a cord guide means 7' and 8' in rails 1 and 3 respectively and back to collector 6.

For retracting or extending the blind assembly the double cord or cord member 9 will simply act as a single cord loop.

Finally a transmission element or abutting member 11 having eyelets 12 and 13 at its two extremities is provided in said top rail 1.

Eyelet 12 guides one part of the double cord 9*b,* whereas the other eyelet 13 guides cord 4.

Conceivably the extension cord 4 is withdrawn into the head rail by an elastic member. The elastic member exerts a biasing force on the lowered rail which may counteract the lowering of the triangular section. Otherwise a weight could be used to obtain a biasing force. Such an arrangement will be described with respect to FIG. 7. The embodiment according to FIG. 1, however, allows the elimination of any biasing force in the extension cord. Withdrawal of the extension cord in the head rail has been obtained in a different manner, which will now be described in more detail.

According to the invention, the looped connection 10 provides the additional function of forming an engaging member for the withdrawal of the extension cord 4. For this purpose the transmission element 11 may be moved lengthwise of the head rail 1. The eyelet 13 engages the extension cord 4, which at one end is attached to the head rail at 14 and at its lower end to the bottom rail at 15. By withdrawing the lift cords 5 and 9 from the head rail through the common cord connector 6, the bottom rail 3 can be raised and pivoted towards the head rail 1.

It is important to note that the length of the portion of the first branch of lift cord 5 that extends between the head rail 1 and the bottom rail 3 equals the accumulated length of portions of the second branch of lift cord 9 that extends between the head rail and the bottom rail at two locations, when this length is divided by the number of times that a respective lift cord crosses the distance between the head and bottom rail of the respective lift cord. The loop of cord 9 enables this cord to accommodate itself to the displacement of the cord 5 thereby eliminating any difference in cord travel amongst cords 5 and 9. It is thus seen that a single cord 5 if placed intermediate of two branches of a looped cord 9 will yield a homogenous amount of cord travel. The looped connection or engagement means 10 at a predetermined stage of lift engages the eyelet 12 of the transmission element 11.

Upon further raising of the blind the opposite eyelet 13 will start to withdraw the extension cord 4 to be gathered along the length of the head rail 1.

The doubling of cord 9 and the looped connection 10 enable the cord to travel over guide surfaces without being obstructed thereby while still reliably engaging the eyelet 12. Before connecting the individual cords together in the cord connector 6, adjustment is made to cord 9*b* to ensure that the guide cord 4 is fully withdrawn with the blind in a raised position. This results in the proper positioning of engagement means 10. Modification will, however, be within the scope of the invention and should be understood to comprise any knot or bead replacing the looped connection 10 and being arranged on a single cord which may be a replacement for double cord 9. If suitable adaptions are made to allow unhindered transition over the guide surfaces also such a modified cord and engagement means may be a realistic proposition.

Figure 2:
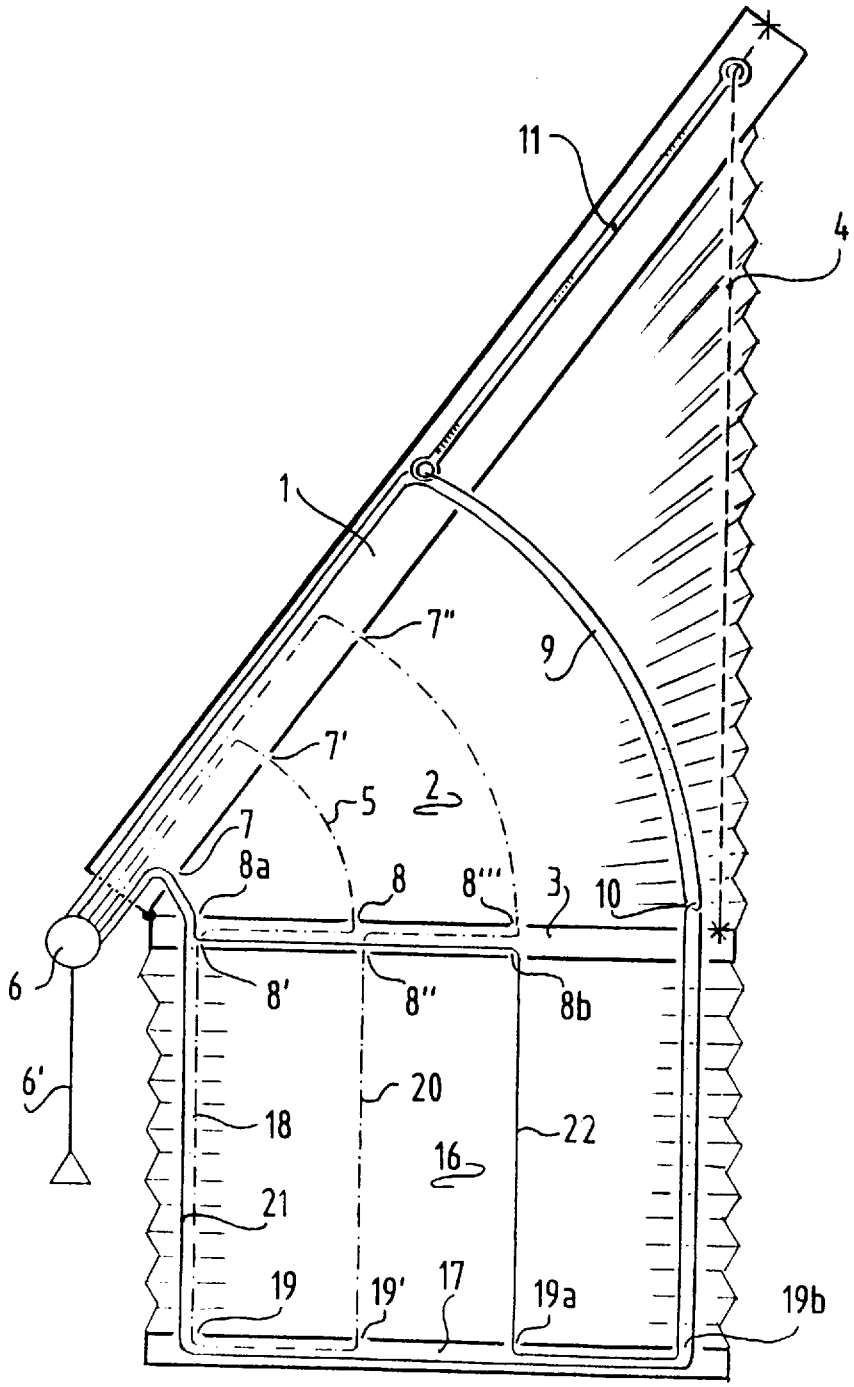
FIG. 2 is a schematic elevated view of the blind according to a second embodiment of the invention.

FIG. 2 schematically shows a raisable blind or shade assembly having a triangular upper blind section 2 and a rectangular lower blind section 16.

In FIG. 2 the same reference numerals for the same parts of the blind are used.

An inclined fixed head rail 1 is disposed at the top edge of the upper section 2 and a movable bottom rail 17 is connected to a bottom edge of the lower section 16.

An intermediate rail or stiffener member 3 is pivotally arranged between the upper and lower blind sections. The intermediate rail 3 thereby being pivotable with respect to the fixed rail 1 about a pivot centre adjacent to the lowermost end of the fixed rail 1.

Two branches of lift cord 5 and 9 routed through and deflected by the head, intermediate, and bottom rails to extend from and return to a common cord collector 6 which can be manually actuated by depending cord member 6'. Lift cord 5 has a first branch extending from a cord guide means 7' in the head rail to a cord guide 8 in the intermediate rail. Lift cord 5 is deflected in the intermediate rail 3 to extend downwardly therefrom from a cord guide 8' left of cord guide 8. A second branch 18 of cord 5 thereby extends downwardly towards cord guide 19 by which the lift cord 5 is deflected towards the right to extend again upwardly from a cord guide 19'. A third branch 20 of lift cord 5 crosses the distance between bottom rail 17 and intermediate rail 3 and engages the latter through cord guide 8". The cord guide 8" deflects cord 5 to the right of intermediate rail 3 to allow cord 5 to extend therefrom upwardly from cord guide 8'". The distance between cord guide 8'" on intermediate rail 3 and cord guide 7" on head rail 1 is spanned by a fourth branch 5' of cord 5. Cord guide 7" deflects cord 5 downwardly to the left and towards cord connector 6.

The lift cord 9 is again a double cord loop having an intermediate loop connection 10 similar to FIGS. 1 and 4*a*–4*e*.

An extension cord 4 is engaged and withdrawable by a transmission member 11 which is engaged by the loop connection 10 after a predetermined amount of lift. For a detailed description of this cord arrangement reference is made to the description of FIG. 1 which has a substantially similar arrangement.

The lift cord 9, although being doubled over a large portion of its routing path is partially separated into spaced branches 21 and 22 while extending across the lower blind section 16. The lift cord branch 21 is deflected by cord guide 19, whereas branch 22 is being deflected by cord guides 8*b* and 19*a*.

It is further seen that the portions of lift cord that are at the intermediate rail 3 and which run along the length thereof are positioned within ⅔ of the length of said intermediate rail from its pivot centre. This causes the cord friction occurring at cord guide 8, 8', 8", 8'", 8*a* and 8*b* not to counteract the lowering of the intermediate rail 3 to any great extent. It will be clear that such friction inducing deflecting points, if concentrated at the far end of the intermediate rail away from its pivot centre may counteract lowering of rail 3 to such an extent that the bottom rail 17 lowers ahead of the intermediate rail and jams itself at the window side. This would be objectionable. It will also be seen that the cord branches are symmetrically arranged in the rectangular bottom portion 16, with branches of cord 5 and 9 balanced on either side of the middle to allow parallel lifting of the bottom rail 17. This effectively eliminates skewing of the bottom rail.

Figure 3:
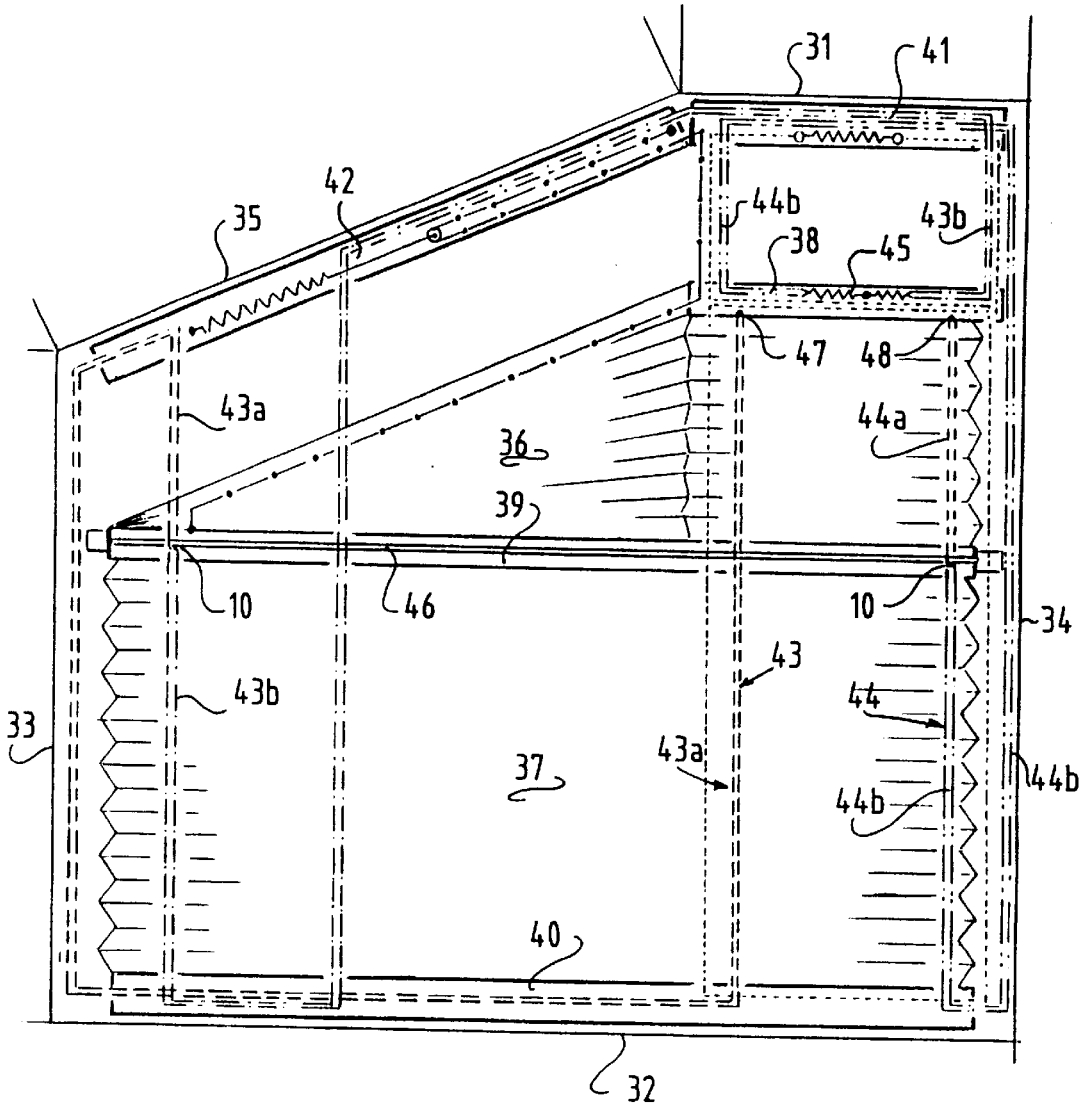
FIG. 3 is a schematic elevated view of the blind according to a third embodiment of the invention, FIGS. 4*a,* 4*b,* 4*c,* 4*d* and 4*e* are schematic views of different embodiments of the loop connection in the cords of a blind assembly according to the invention.

The embodiment according to FIG. 3 is related to a blind, adapted to be used in a pentagonal opening or window. The opening comprises a top side 31, a bottom side 32, a left hand vertical side 33, a right hand vertical side 34 and a sloping side 35, connecting the top side 31 and left hand side 33.

In the embodiment, shown in FIG. 3, the blind itself is formed by a pleated material, having a pentagonal form in the extended situation, said blind comprising a trapezoidal section 36, and a rectangular section 37.

The pleated material of the trapezoidal section 36 is provided with a movable top rail 38, and a movable intermediate rail 39. The rectangular section 37 is bordered by said intermediate rail 39 and a fixed bottom rail 40.

Moreover, along the top side 31 and sloping side 35 two fixed rails 41 and 42 are arranged.

The blind itself can be brought from the open to the closed position and vice versa by moving the top rail 38 manually in upward and downward direction. For guiding the pleated material and the intermediate rail 39, the top rail 38 is provided with two cord loops 43 and 44 respectively. The cord loops comprise two parts of a double cord 43*a* and 43*b*, which are connected to each other at 10, comparable with the looped connection in FIGS. 1, 2 and 4*a–e*. The cord loop 44 is also divided in two parts 44*a* and 44*b*, being also connected at 10 forming a looped connection.

Both cord loops 43, 44 are slidably guided through the intermediate rail 39, the bottom rail 40 and the head rails 41, 42 respectively. From the head rail 41 the end portions of the parts 43*b*, 44*b* are routed back to the movable rail 38, where the extremities are connected to a biasing spring 45. The extremities of the cord parts 43*a*, 44*a* are connected to the movable rail 38 at 47, 48 respectively.

Herewith it is noted that the two threads of the double cord 43*a*, 44*a* are guided in a straddling configuration over an elongated bar or cord 46, in the intermediate rail 39.

The position of the movable rail 38 with respect to the intermediate rail 39 is such that the looped connection 10 is in engagement with the bar 46. So when moving the top rail 38 upwards the intermediate rail 39 will be taken along with this movement as the looped connection 10 will engage the bar 46 in the upward movement. In this way the complete blind can be closed when moving the top rail 38 more upwardly beyond the position illustrated in FIG. 3.

When lowering the head rail 38 in downward direction, the intermediate rail 39 will still be supported from the looped connection 10 of the two cords 43, 44, but when reaching the bottom rail 40, the looped connection 10 will become free of the bar 46 and the cord portions 43*a*, 44*a* can move freely past the bar and through the bottom rail 40. Lowering the movable rail 38 further downwards, the complete trapezoidal section can be folded to uncover the pentagonal opening.

Also in this embodiment there is made use of a looped connection 10 of a double cord, said looped connection forming an engagement means in the cord loop, said engagement means co-operating with an abutting member, like the eyelet 12 in FIGS. 1 and 2 or the bar 46 in FIG. 3.

A plurality of arrangements possible with such a looped connection is depicted in FIGS. 4*a–e*.

Figure 4A:
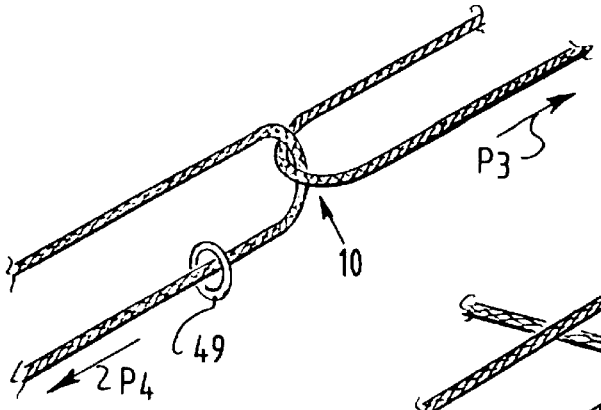

FIG. 4*a* discloses a looped connection co-operating with an eye-let 49, comparable with an eye-let 12 of the transmission member 11 in FIGS. 1 and 2.

Figure 4B:
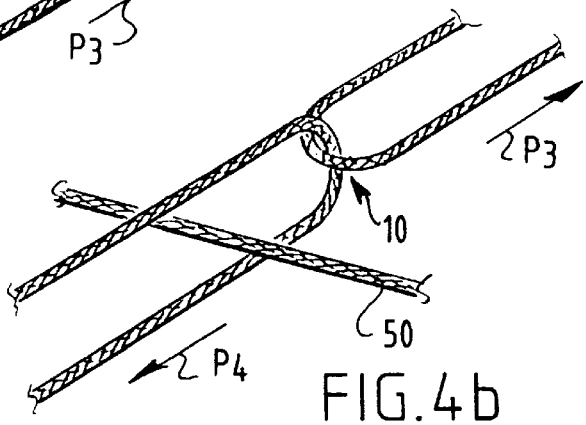

FIG. 4*b* discloses a looped connection 10 co-operating with an abutting member in the form of a cord or thread 50, comparable with the abutting member 46 in the embodiment of FIG. 3.

Figure 4C:
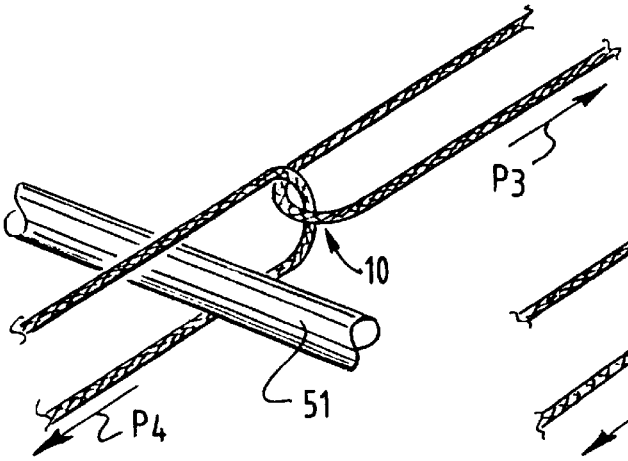

FIG. 4*c* is an alternative of the cord 50 in FIG. 4*b*, and the abutting member is formed here by a bar or rod 51.

Figure 4D:
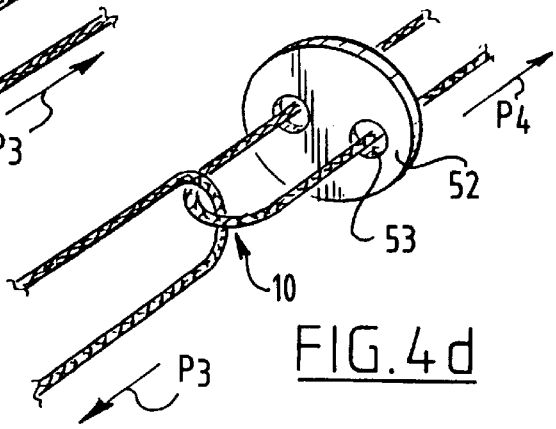

In FIG. 4*d* the abutting member is formed by a disk 52 provided with two apertures 53, through which the parts of the one cord portion are slidably guided.

Figure 4E:
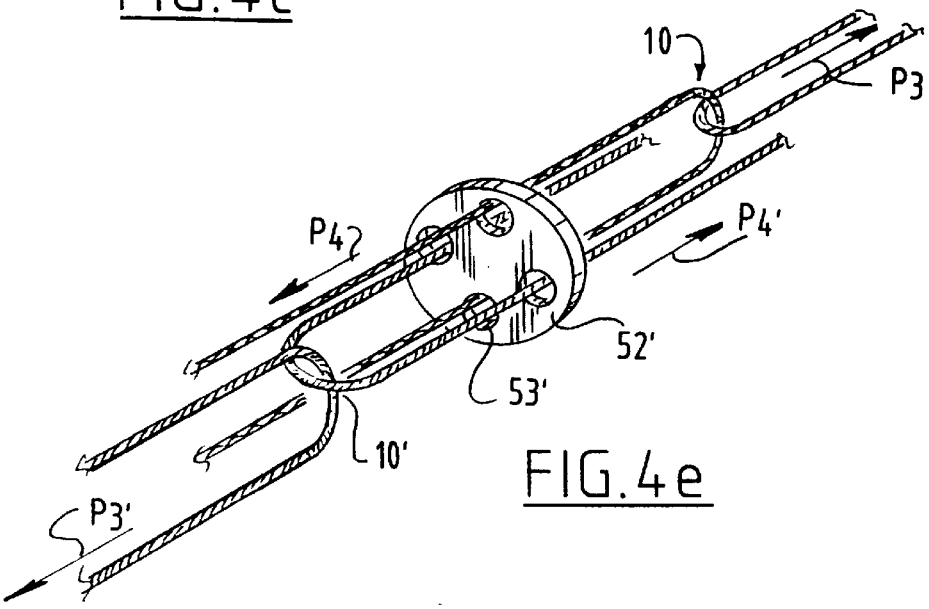

FIG. 4*e* is a double embodiment, wherein two cord loops are parallel to each other, whereas both are provided with a looped connection 10, 10' respectively. The abutting member 52' is provided with four apertures 53' for taking up the cord parts of the one loop and the other loop.

In the drawings the arrow P3 indicates the free movement of the cord loop along the abutting member, whereas in the reverse direction the arrow P4 indicates the blocked movement, wherein the looped connection will abut to the abutting member.

Figure 5:
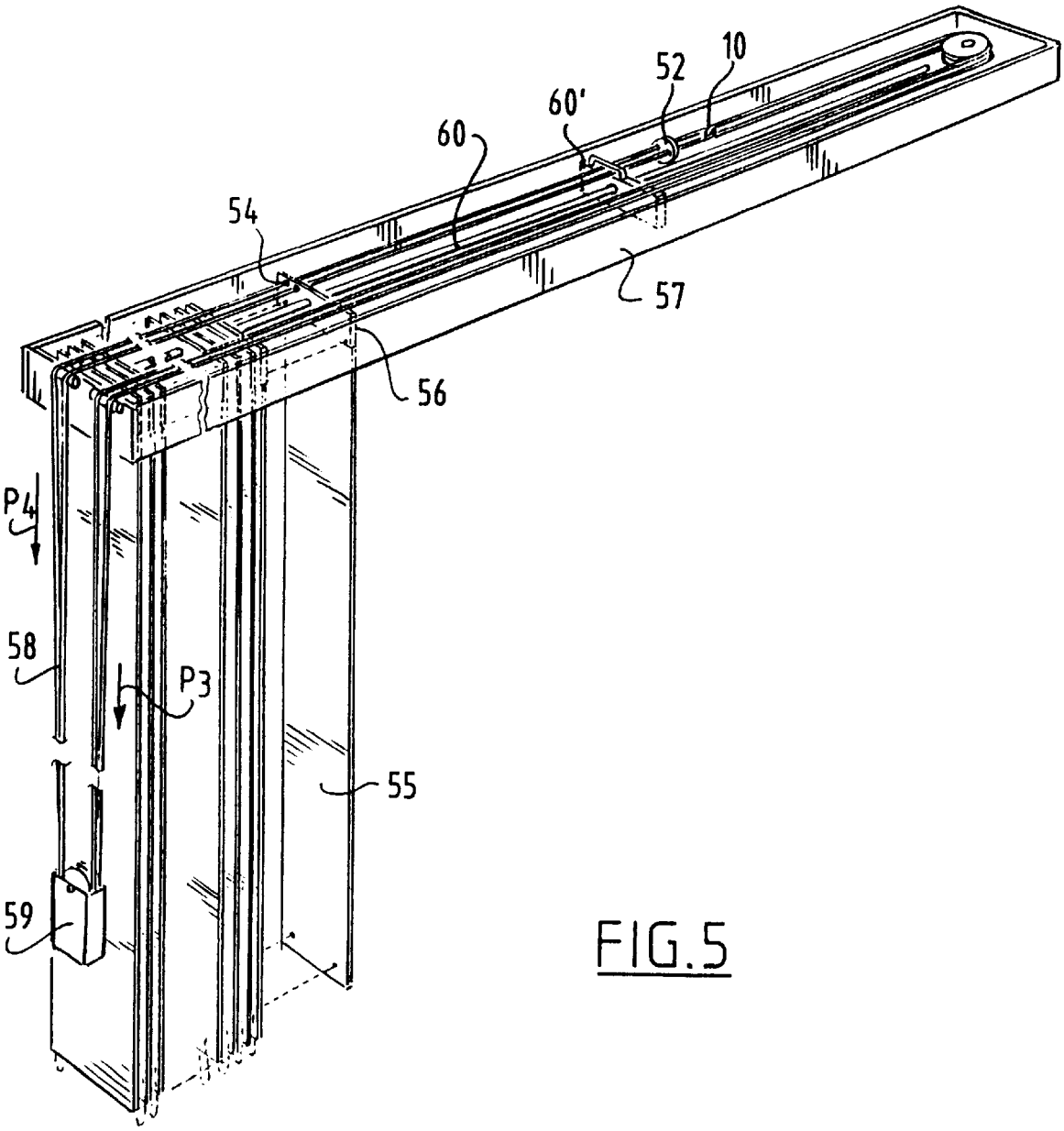
FIG. 5 is a perspective view of a fourth embodiment of a blind assembly according to the invention.

Turning now to FIG. 5 such a cord loop having a looped connection 10 is also applicable to blinds or shades of a different kind.

FIG. 5 is depicting an embodiment of a so-called slat-blind, wherein the slats 55 are each suspended from a carrier 56, which are slidably guided in a head rail 57. A cord loop 58 is led through the head rail 57 and depends from the head rail downwards and will be biased by a weight 59 with a return pulley.

The slats 55 can be drawn to the right in FIG. 5 by connecting the right hand outer carrier 56 to the terminal parts of the cord loop 58 at 54, whereupon each of the carriers 56 will trail its neighbouring carrier by means of spacer means as is well-known in the art and therefor not described further. The spacer means will provide a predetermined distance between adjacent carriers 56 when the slats 55 are evenly distributed over the head rail 57.

In the head rail 57 a driving shaft 60 is provided to effect angular adjustment of the slats 55 about a vertical pivot (not shown but well-known in the art and therefor not further described). When long head rails 57 are used, the driving shaft 60 must be supported, when all the slats 55 are retracted to the left hand side in FIG. 5. Such a support can be embodied by an auxiliary carrier 60' slidably guided in the head rail 57. The cord loop 58 is embodied by double cords having a looped connection 10 shown at the right hand side of the carrier 60', said looped connection is provided with an abutting member such as a disc 52 similar to that of FIG. 4*d*.

It will be clear that, when pulling the left hand depending portion of the looped cord 58 in the direction of arrow P4 the abutting member 52 will abut against the auxiliary carrier 60' taking the auxiliary carrier 60' along to the middle of the head rail 57, so supporting the driving shaft 60.

When pulling the front portion of the cord loop 58 in the direction of arrow P3, the cord 58 can freely move with respect to the auxiliary carrier 60' and when the outermost carrier 56 will abut the auxiliary carrier 60' both carriers will be pulled to the extreme right hand end of the head rail 57.

Figure 6:
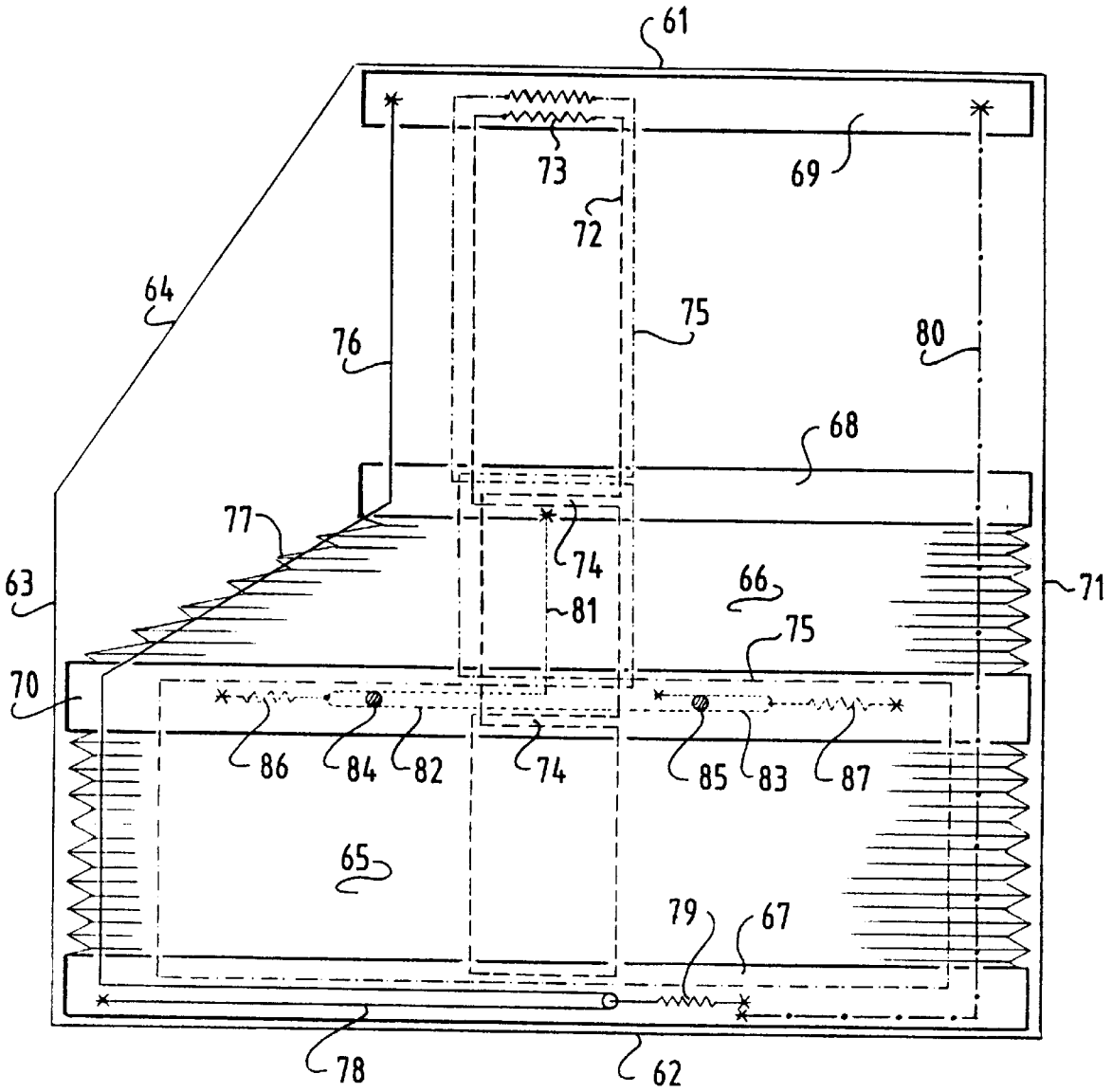
FIG. 6 is an elevated view of a fifth embodiment of a blind used in a polygonal window opening.

The embodiment of shown in FIG. 6 is a blind assembly adapted to be used in a pentagonal window area having parallel bottom and top edges 61, 62 and a partly perpendicular side edge 63 followed by an inclined top portion 64. The other side edge 71 is shown as a fully perpendicular side edge, but could also be a mirror image of sides 63 and 64. The blind material, which could be a pleated, cellular or slatted blind has a rectangular bottom section 65 and a trapezoidal top section 66.

Along the bottom edge of the window opening is affixed a fixed rail member 67 and along the top edge 61 is affixed a further fixed rail member 69. Movable between these fixed rail members is a movable rail member 68, which is parallel to said fixed rail members and is movable from rail member 67 towards rail member 69 to close the blind.

Inbetween the rectangular blind section 65 and the trapezoidal blind section 66 is attached a further movable rail member 70.

As is futher shown in FIG. 6 a cord loop is provided to guide and retain the movable rails 68 and 70.

The cord loop 72 is closed by an elastic means, such as a spring 73 to provide tension in said cord loop. Further it can be seen in FIG. 6 that the cord loop 72 crosses over at 74 from left to right in the movable rail 68 and crosses over back again in a similar fashion in rail 70.

This eight-shaped cord looping provides for the parallel guiding of the movable rails in relation to the fixed rails and the cord tension together with friction at the deflecting point will retain the movable rails in any adjusted position.

If the cord loop additionally extends through openings in the shading material sections 65 and 66, as is conventional in the art, then support and guiding for the blind material is also provided.

FIG. 6 illustrates a further eight-shaped cord loop 75, somewhat similar to the cord loop 72, but wider in shape to provide for additional support and guiding of the rectangular section.

Further FIG. 6 shows a left hand guide cord 76, which is provided for the support and guiding of the inclined edge 77 of trapezoidal section 66.

Guide cord 76 is provided with length compensating means in the form of a spring tensioned return loop 78, tensioned by a spring 79. The length compensation means 78, 79 are conveniently accommodated in the fixed bottom rail 67.

Further a guide cord 80 may be provided at the right hand edge 71.

Because the right hand edge 71 is straight and perpendicular to the top and bottom edges, no length compensation will be needed for this cord.

Finally FIG. 6 shows an extension limiting cord 81, which serves to limit expansion of the trapezoidal blind section.

This extension limiting cord 81 is payed out from the movable intermediate rail 70 and comprises the necessary return loop 82, 83, end stops 84, 85 and spring means 86, 87 to supply and retract the required amount of length.

The extension cord 81 ensures that the blind section is not overstretched and that blind section 65 and movable bar 70 will also follow the movement of said movable top bar 68.

Similarly the rectangular blind section 65 could be provided with an extension limiting cord if desired.

Accommodation of such limiting cord means could be found in any of the movable or fixed beams.

Figure 7:
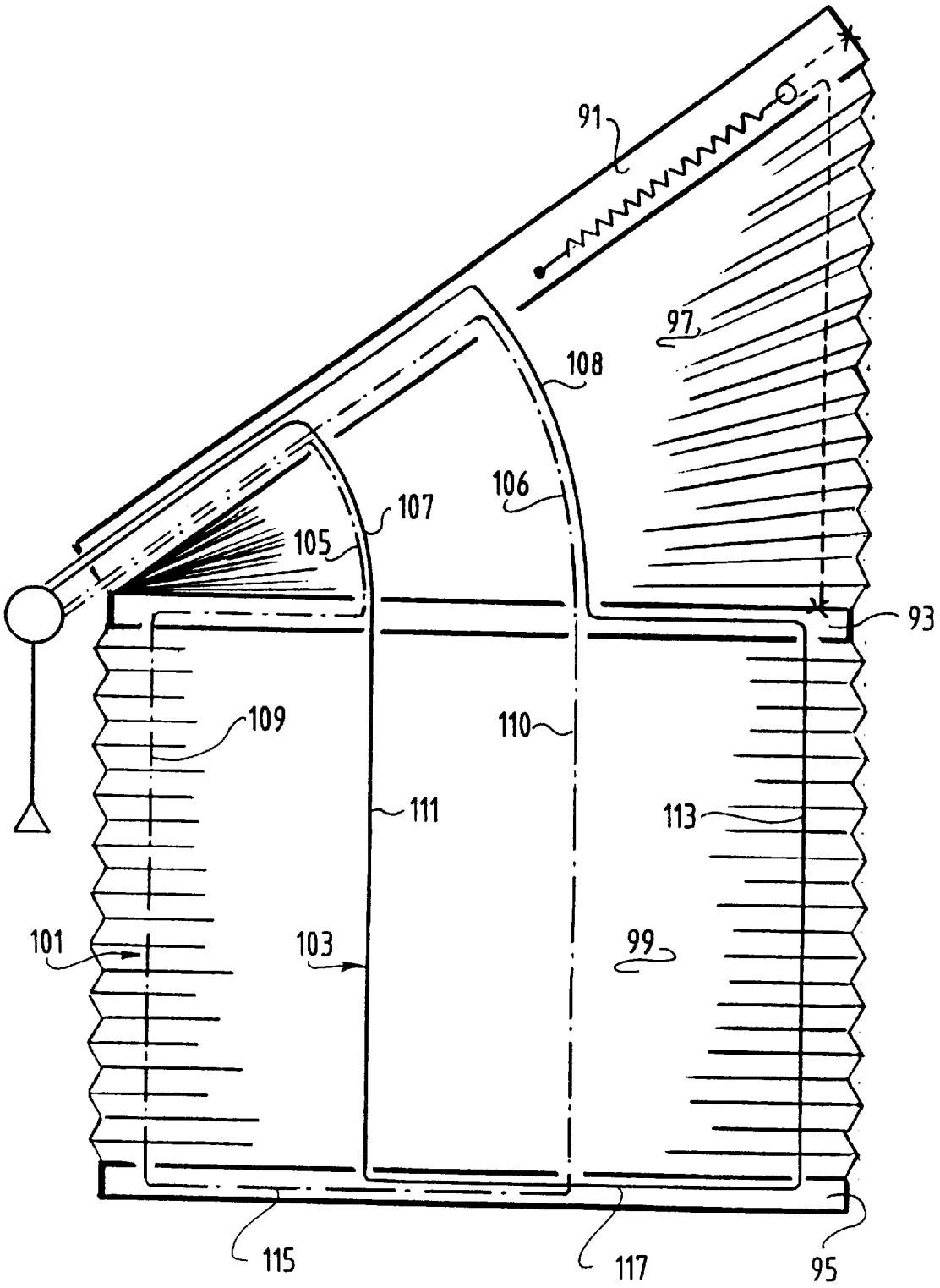
FIG. 7 is a schematic elevation of a sixth embodiment shown in its extended condition.

The embodiment shown in FIG. 7 is very similar to that of FIG. 2 but has a cord arrangement adapted for blinds of greater width dimensions. The arrangement of headrail 91, intermediate rail or stiffener member 93 and bottom rail 95 is similar to previous embodiments. Also a triangular blind section 97 and a rectangular blind section 99 may be arranged in the areas defined by the rails 91, 93 and 95. It should be noted, however, that the arrangement of blind sections is according to requirements. One could for instance chose a different kind of blind material for the triangular section as for the rectangular section. Also, one could leave the triangular area 97 open and only have a blind member between the horizontal rails 93 and 95. Generally one could describe the covering members of the blind as passive elements in the process of raising and lowering whereas the individual rail members and cords are the more active elements. While functioning as a shading device the covering members will have a more active role than any of the other elements. It will thus be clear that the arrangement of lift cords, guiding cords and rails is rather independent of the precise nature of the blind or shading device deployed or raised therewith. It is seen in FIG. 7 that lift cord 101 is routed almost symmetrically to the other lift cord 103. More in particular, lift cord 101 crosses the distance between the head rail 91 and the intermediate member 93 along the path 105 and along path 106.

The other lift cord 103 crosses the distance between the head rail and the intermediate member a similar number of times and along paths 107 and 108, which are of similar length to the paths 105 and 106 of cord 101.

Cord guiding means and cord deflecting elements are generally similar to those described in connection with FIG. 2 and are therefore not separately referred to in FIG. 7. Similar considerations apply to the lift cord collecting and operating element as well the extension cord along the vertical edge.

I claim:

1. An extendable and retractable blind assembly comprising a first rail member adapted to be fixedly mounted to a support structure, a second rail member being movable to and from said first rail member, said first and second rail members being angled with respect to one another in a plane common to said first and second rail members, at least one lift cord having ends and arranged in said blind assembly as a closed loop with said ends of said at least one lift cord connected together outwardly of said first rail member, said at least one lift cord having sections extending longitudinally of said first rail member, sections extending longitudinally of said second rail member and sections extending between said first and second rail members, a second lift cord having sections extending between said first and second rail members, wherein said sections of said at least one lift cord and said sections of said second lift cord which extend between said first and second rail members, together define two distinct cord paths in each of which paths portions of said at least one lift cord and said second lift cord coextend in a parallel relationship.

2. A retractable blind or shade assembly for covering a polygonal contoured surface area, comprising a retractable covering member, a movable member, an abutting member operatively associated with said movable member, at least one cord member for retracting said covering member, said at least one cord member having two terminal ends and being provided between said two terminal ends with an engagement means engaging said abutting member upon a predetermined amount of relative movement between said engagement means and said abutting member when said engagement means moves in a first direction longitudinally of said at least one cord member, and wherein said at least one cord member comprises two doubled over cord branches that are looped into each other at a closed end of each doubled over cord branch to form an intermediate loop connection, and further wherein said engagement means comprises one of said closed ends of one of said doubled over cord branches.

3. A retractable blind or shade assembly as claimed in claim 2, wherein engagement of said engagement means and said abutting member will move said movable member.

4. A retractable blind or shade assembly as claimed in claim 3, wherein said abutting member is provided with an aperture for slidably guiding said at least one cord member.

5. A retractable blind or shade assembly as claimed in claim 3, wherein said abutting member is a further cord element.

6. A retractable blind or shade assembly as claimed in claim 3, wherein said abutting member is a bar.

7. A retractable blind or shade assembly as claimed in claim 2, further comprising a fixed support rail and wherein said movable member is a movable rail movable to extend and retract at least part of said covering member.

8. A blind or shade assembly for a polygonal window area having parallel top and bottom edges and at least one compound side edge comprising a first portion perpendicular to said top and bottom edges and a second portion inclined to said top and bottom edges of said window area, said blind being adapted to be contractible towards a largest of said top and bottom edges and adapted to be expandable towards a smallest of said top and bottom edges, said blind having a rectangular section adapted to cover an area defined by said largest of said top and bottom edges and said first portion of said at least one compound side edge of said window area and a trapezoidal section adapted to cover the remaining area of said window area, said rectangular section and said trapezoidal section are joined to one another, said blind comprising a fixed rail member adapted to be fixed to said largest of said top and bottom edges of said window area and a movable rail member adapted to being of a same length as said smallest of said top and bottom edges of said window area, and for being movable towards same, a further fixed rail member being adapted to be fixed along said smallest of said top and bottom edges of said window area, a retaining cord loop being provided between said fixed top and bottom rail members, said retaining cord loop being closed by a tensioning member in at least one of said fixed rail members, said retaining cord loop extends through said movable rail member and a left hand branch of said retaining cord loop being deflected to overcome a right hand branch of said retaining cord loop extending from the other end of said movable rail and vice versa, so that said left hand branch and said right hand branch cross one another in said movable rail so as to form an eight shape loop, further said blind being provided with a guide cord which extends adjacent to an inclined edge of said trapezoidal section for support and guiding of said inclined edge, said guide cord having an elastic means for compensation of a difference in length resulting from different positions of said guide cord in blind open and blind closed positions, and an extension limitation cord limiting a predetermined amount of extension of said trapezoidal section.

9. A retractable blind or shade assembly for covering a polygonal contoured surface area, comprising a retractable covering member, a movable member and at least one cord member having terminal ends, wherein said at least one cord member is provided between said terminal ends with engagement means, said engagement means engaging said movable member upon a predetermined amount of relative movement between said movable member and said at least one cord member in a first direction, while otherwise said movable member and said at least one cord member never move in unison, wherein said at least one cord member comprises two doubled over cord branches connected to each other at an intermediate loop connection, and further wherein said engagement means comprises said intermediate loop connection and is formed by a closed end of one of said doubled over cord branches.

10. A retractable blind or shade assembly as claimed in claim 9, wherein engagement of said engagement means and said movable member is by means of an abutting member, said at least one cord member being slidably guided by said abutting member.

11. A retractable blind or shade assembly for covering a polygonal contoured architectural area, comprising a retractable covering member, at least one pair of looped cords for retracting said retractable covering member, said at least one pair of looped cords having interengaging loops and doubled over cord branches co-extending in opposite directions from said interengaging loops and an abutting member through which one of said co-extensive cord branches is guided, wherein said interengaging loops are adapted to engage said abutting member upon a predetermined amount of lost motion between said interengaging loops and said abutting member in one direction longitudinally of said at least one pair of looped cords, while otherwise movement between said interengaging loops and said abutting member longitudinally of said at least one pair of looped cords is independent of one another.

12. A retractable blind or shade assembly as claimed in claim 11, wherein said abutting member is adapted to move in unison with said interengaging loops.

13. A retractable blind or shade assembly as claimed in claim 11 or 12, wherein said abutting member comprises an aperture for slidably guiding said one of said co-extensive cord branches.

14. A retractable blind or shade assembly as claimed in claim 13 wherein movement of said interengaging loops to engage said abutting member causes movement of a movable member.

15. A retractable blind or shade assembly as claimed in claim 11, wherein said at least one pair of looped cords is arranged in a closed loop and wherein opposite terminal ends of co-extensive cord branches are connected for simultaneous movement.

16. A retractable blind or shade assembly as claimed in claim 11, wherein said retractable covering member is mounted for retraction on a fixed rail.

17. A retractable blind or shade assembly as claimed in claim 11 or 16, wherein said retractable covering member includes a triangular surface element.

18. A retractable blind or shade assembly as claimed in claim 14, wherein said movable member is an intermediate rail member.

19. A retractable blind or shade assembly as claimed in claim 14, wherein said retractable covering member comprises a trapezoidal surface element and said movable member is an intermediate rail.

20. A retractable blind or shade assembly as claimed in claim 14, wherein said retractable covering member comprises a plurality of vertical vanes and said movable member is a shaft support.

21. An extendable and retractable blind assembly, comprising a first rail member adapted to be fixedly mounted to a support structure, a second rail member being movable between an extended position away from said first rail member and a retracted position adjacent to and parallel with said first rail member, in said extended position of said blind assembly, said first and second rail members being angled with respect to one another in a plane common to said first and second rail members, at least one lift cord having ends and being arranged in said blind assembly as a closed loop, wherein said ends of said at least one lift cord are connected together outwardly of said first rail member, said at least one lift cord in between said ends is provided with engagement means adapted to engage a movable member upon a predetermined amount of movement of said at least one lift cord towards retraction of said blind assembly, whereupon further movement of said at least one cord results in movement of said movable member along a path communal with said at least one cord by means of said engagement means.

22. An extendable and retractable blind assembly comprising a first rail member adapted to be fixedly mounted to a support structure, a second rail member being movable between an extended position away from said first rail member and a retracted position adjacent to and parallel to said first rail member;

in the extended position of the blind said first and second rail members being angled with respect to one another in a plane common to said first and second rail members, said blind assembly comprising a triangular upper section, said second rail member having a length and being pivotable with respect to said first rail member about a pivot center adjacent to one end of said first rail member, a rectangular lower section extends below said second rail member opposite of said first rail member, and a movable third rail member being connected to a bottom edge of the lower section, at least two branches of lift cord extending from said first rail member to said third rail member, said third rail member being suspended from said first rail member by a return loop in at least one of said branches of lift cord extending through said third rail member, wherein the total length of lift cord of one branch between said first and second rail members equals the length of lift cord of the other branch extending therebetween; and wherein at least two portions of lift cord are deflected at said second rail member to run along the length thereof and said deflections being positioned within two thirds of said length of said second rail member from said pivot center.

23. An extendable and retractable blind assembly according to claim 22, wherein one branch of said at least two branches of lift cord is threaded through a routing path closest to said pivot center and a routing path farthest from said pivot center.

24. An extendable and retractable blind assembly according to claim 23, wherein said one branch of said at least two branches of lift cord is doubled over onto itself and is looped into a further branch of said at least two branches of lift cord is also doubled over onto itself, so as to form an extension of said one branch of said at least two branches of lift cord.

25. Extendable and retractable blind assembly according to claim 24, wherein said doubled over loop connection is adapted to engage a loop in another pull element.

26. An extendable and retractable blind assembly comprising a first rail member having a first end, a second end, and a length, and being adapted to be fixedly mounted to a support structure, a second rail member having a first end, a second end, and a length, and being movable between an extended position away from said first rail and a retracted position adjacent to and parallel to said first rail member;

in said extended position said first and second rail members are angled with respect to one another in a plane common to said first and second rail members with at least one lift cord being arranged in said blind assembly as a closed loop with ends of said at least one lift cord connected together outwardly of said first rail member, wherein said second rail member is pivotable with respect to said first rail member about a pivot center adjacent to said first ends of said first and second rail members; and wherein said blind assembly further comprises first and second cord guiding means positioned longitudinally of said first rail member at spaced locations from said pivot center and third and fourth cord guiding means positioned longitudinally of said second rail member and identically spaced from said pivot center as said first and second cord guiding means on said first rail member; said first and third cord guiding means defining a first cord routing path and said second and fourth cord guiding means defining a second cord routing path for a lift cord extending between said first and second rail members, each said first cord routing path and said second cord routing path being positioned generally along one side of a triangle formed between said pivot center and said first and third cord guiding means, and between said pivot center and said second and fourth cord guiding means, respectively, and first and second branches of lift cord being provided, said first branch of lift cord forming a closed loop having a first portion routed downwardly along said first cord routing path and a second portion routed upwardly along said second cord routing path, said second branch of lift cord being connected at one point along its length to said first branch of lift cord to be movable in unison therewith, means for allowing engagement of said first and second branches of lift cord outwardly of said first rail member to enable extension and retraction of said blind assembly;

wherein a length of said first and second portions of said first branch of lift cord extending between said first rail member and said second rail member when divided by a number of routing paths of these portions equals a length of at least one portion of said second branch of lift cord extending between said first rail member and said second rail member when divided by a number of routing paths for said second branch of lift cord therebetween; and further wherein an additional section of said blind assembly extends beyond said second rail member oppositely of said first rail member, and a movable third rail member being connected to an edge of said additional section opposite of said second rail member, and pivotal movement of said second rail member being limited by a retractable guide cord extending between said first rail member and said second rail member at locations along said lengths of said first and second rail members adjacent said second ends thereof away from said pivot center, said guide cord being retractable upon retraction of said blind assembly.

27. An extendable and retractable blind assembly according to claim 26, wherein a retractable covering member is provided between said first and second rail members, wherein further cord guiding means are provided on said covering member intermediate said first and third cord guiding means and intermediate said second and fourth cord guiding means, respectively, and wherein said first and second cord routing paths extend along an arcuate path about said pivot center.

28. An extendable and retractable blind assembly according to claim 26, wherein a total number of cord routing paths between said first rail member and said second rail member is an odd number and wherein all but a central one of said lift cords form a closed loop.

29. An extendable and retractable blind assembly according to claim 26, wherein at least one portion of said first and second branches of lift cord is deflected to extend along said length of said second rail member and deflection of said at least one portion being at a cord guiding means positioned within two-thirds of said length of said second rail member from said pivot center.

30. A retractable blind or shade assembly for covering a polygonal contoured surface area, comprising a retractable covering member shaped to cover said surface area and defining an upper edge, at least one side edge, and at least one lower edge, a headrail secured to said covering member along said upper edge thereof, a movable member swingably engaged with said headrail and secured to said covering member along said at least one lower edge, an extension and support cord extending between said headrail and said movable member adjacent said covering member at least one side edge, a transmission member housed in said headrail and operatively associated with said extension and support cord, a cord collector, and at least one lift cord member for retracting said covering member towards said headrail and having a plurality of cord branches and terminal ends secured to said cord collector, said at least one lift cord member defining between its said terminal ends interengaging loops formed by two doubled-over cord branches, one of said loop defining cord branches interconnecting with said transmission member whereby a loop defined by said one of said loop defining cord branches forms a lost motion connection between said at least one cord member and said transmission member and thereby with said extension and support cord for retracting said extension and support cord when said covering member is retracted by pulling on said cord collector.

31. A retractable blind or shade assembly as defined in claim 30, wherein said transmission member is an elongated rod having an eyelet on each end thereof for guidably receiving said one of said loop defining cord branches and said extension and support cord, respectively.

32. A retractable blind or shade assembly for covering a polygonal contoured surface area, comprising a retractable covering member, a fixed support rail, a movable rail movable to extend and retract at least part of said covering member, wherein said movable rail and said fixed support rail in an extended position are angled with respect to one another in a plane common to said fixed and movable rails, and further wherein said movable rail is pivotable with respect to said fixed support rail about a pivot center adjacent to one end of said fixed support rail, an abutting member operatively associated with said movable rail, at least one cord member comprising a cord loop for retracting said covering member, said at least one cord member having two terminal ends that are connected together outwardly of said fixed support rail, and said at least one cord member being provided between said two terminal ends with an engagement means engaging said abutting member upon a predetermined amount of relative movement between said engagement means and said abutting member when said engagement means moves in a first direction longitudinally of said at least one cord member, and wherein said at least one cord member comprises two doubled over cord branches that are looped into each other at a closed end of each doubled over cord branch to form an intermediate loop connection, and further wherein said engagement means comprises one of said closed ends of one of said doubled over cord branches.

33. A retractable blind or shade assembly as claimed in claim 32, wherein engagement of said engagement means and said abutting member will move said movable rail.

34. A retractable blind or shade assembly as claimed in claim 33, wherein said abutting member is provided with an aperture for slidably guiding said at least one cord member.

35. A retractable blind or shade assembly as claimed in claim 33, wherein said abutting member is a further cord element.

36. A retractable blind or shade assembly as claimed in claim 33, wherein said abutting member is a bar.

37. An extendable and retractable blind assembly, comprising a first rail member adapted to be fixedly mounted to a support structure, a second rail member being movable between an extended position away from said first rail member and a retracted position adjacent to and parallel with said first rail member, in said extended position of said blind assembly said first and second rail members being angled with respect to one another in a plane common to said first and second rail members, at least one lift cord having ends and being arranged in said blind assembly as a closed loop, wherein said ends of said at least one lift cord are connected together outwardly of said first rail member, said at least one lift cord, in between said ends, is provided with engagement means adapted to engage a movable member upon a predetermined amount of movement of said at least one lift cord towards retraction of said blind assembly, whereupon further movement of said at least one cord results in movement of said movable member along a path communal with said at least one cord by means of said engagement means, and a further lift cord, wherein a loop of said further lift cord is engaged in a loop of said at least one lift cord, said at least one lift cord and said further lift cord are doubled over upon themselves and move in unison through a common path and wherein one of said engaged loops forms said engagement means.

* * * * *